United States Patent [19]

Halbich

[11] Patent Number: 4,915,339

[45] Date of Patent: Apr. 10, 1990

[54] MINE PROP

[75] Inventor: Hagen Halbich, Transvaal, South Africa

[73] Assignee: H L & H Timer Products (Proprietary) Limited, Transvaal, South Africa

[21] Appl. No.: 483,483

[22] Filed: Apr. 11, 1983

[30] Foreign Application Priority Data

Aug. 6, 1982 [ZA] South Africa ..... 82/5699

[51] Int. Cl.[4] ..... F16M 13/00

[52] U.S. Cl. ..... 248/351; 248/357

[58] Field of Search ..... 248/351, 354.1, 354.2, 248/354.3, 354.4, 354.5, 354.6, 354.7, 357, 548; 52/728; 405/250

[56] References Cited

U.S. PATENT DOCUMENTS

| | | | |
|---|---|---|---|
| 3,297,292 | 1/1967 | Paurat | 248/354.6 |
| 4,520,980 | 6/1985 | Townsend | 248/351 |
| 4,534,531 | 8/1985 | Brown | 248/351 |

FOREIGN PATENT DOCUMENTS

| | | | |
|---|---|---|---|
| 83945 | 5/1921 | Fed. Rep. of Germany | 248/354.1 |
| 28784 | 12/1912 | United Kingdom | 248/354.4 |
| 118969 | of 1918 | United Kingdom | 248/548 |
| 319091 | 9/1929 | United Kingdom | 248/354.1 |
| 814350 | 6/1959 | United Kingdom | 248/354 R |

*Primary Examiner*—David M. Purol

*Attorney, Agent, or Firm*—McGlew & Tuttle

[57] ABSTRACT

This invention relates to a mine prop. The prop consists of a timber pole which is cut adjacent one of its ends and over a portion of its length to provide an axially positioned core of reduced cross-section relatively to the uncut portion of the pole, timber on the outside of the cut and at least one hoop of yieldable material surrounding the pole over the core and the timer on the outside of it to restrain expansion of the cone and outer timber in a direction transverse to the pole axis when the prop is reduced in length under a compressive load in its axial direction.

7 Claims, 1 Drawing Sheet

MINE PROP

FIELD OF THE INVENTION

This invention relates to timber mine props.

BACKGROUND OF THE INVENTION

An unmodified timber pole has an extremely limited degree of compression in the direction of the grain of the timber. These props have limited use in deep level mines where the rate of closure of the hanging and footwall is rapid. Numerous expedients, mainly due to considerations of cost, have in the past been resorted to increase the degree of compressibility of timber props and so to prolong their useful lives. With one type of known support the prop is encircled by a ductile metal, glass fibre or like sleeve to increase its compression capability while remaining load supporting. In another type of more cost effective prop one or both ends of an unsleeved prop are tapered. A major difficulty, however, with all known types of yieldable elongate timber is that one or both ends of the props burr radially outwardly as the props is reduced in length under load and that more often than not one of the burring ends brushes to one side to cause the prop to skew and become ineffective as a load support.

OBJECT OF THE INVENTION

It is the object of this invention to provide a timber mine prop which is yieldable to a far greater degree while under load than a plain timber prop.

SUMMARY OF THE INVENTION

A mine prop according to the invention includes a timber pole which is cut adjacent one of its ends and over a portion of its length to provide a core of reduced cross-section relative to the uncut portion of the pole, timber on the outside of the cut and a hoop surrounding the pole over the core and timber on the outside of it to restrain expansion of the core and outer timber in a direction transverse to the pole axis when the prop is under a compressive load in its axial direction.

In one form of the invention the core is defined by two cuts which are made into the end of the prop from positions in the end of the prop in which the cuts are parallel to each other and equally spaced from the prop axis.

In another form the core is defined by four cuts which are made into the end of the prop from positions in the end of prop in which the cuts are at right angles to each other about the prop axis.

In yet other forms of the invention the cuts define a core which is triangular, circular or any other suitable shape in cross-section.

The cuts which define the core may slope from the end of the prop either towards or away from the prop axis. If the cuts are made to slope away from the axis it is preferable that they do not intersect the side of the prop so that the timber on the outside of the core remains integral with the remaining pole timber.

The hoop is made from any suitable material which is yieldable. One such material is mild steel which may be in rod form.

BRIEF DESCRIPTION OF THE DRAWINGS

The invention is now described by way of example only with reference to the drawings in which.

DETAILED DESCRIPTION OF THE DRAWINGS

Figure 1:
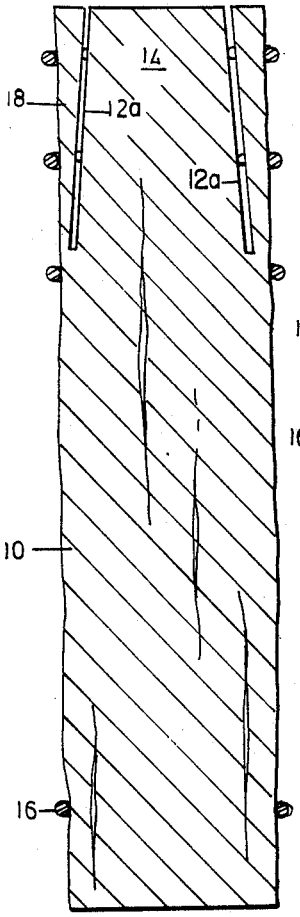
FIG. 1 is a sectioned side elevation of one embodiment of the prop of the invention.

The props of the invention are shown in the drawings to consist of elongate timber poles 10 which each carry at least one cut slot designated by 12*a*, 12*b*, 12*c*, 12*d*, 12*e*, 12*f* and 12*g* in the respective drawings 12 which defines a central load supporting core 14 which extends over a portion of the length of the pole and four restraining hoops 16.

The pole timber is a fairly hard timber such as saligna.

The hoops 16 are made from mild steel rod which is about 6 mm in diameter. The purpose of the lowermost hoop 16 on the prop is to prevent premature cracking of that end of the prop.

Figure 2:
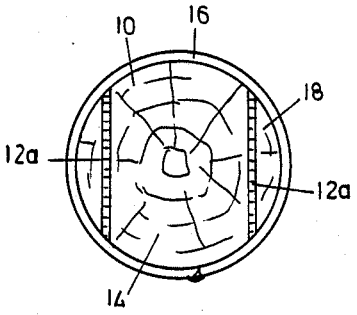
FIG. 2 is a plan view of the FIG. 1 prop.

The core 14 of the prop of FIGS. 1 and 2 is defined by two initially parallel cuts 12 or cut slots 12*a* which slope from the end of the prop towards the sides of the pole 10 so that the core increases in cross-section towards its base.

Figure 3:
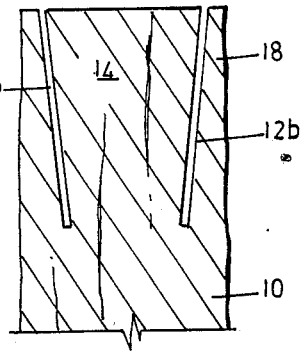
FIG. 3 is a sectioned side view of one end of a second embodiment of the prop.
Figure 4:
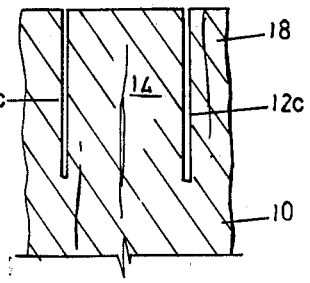

In the FIG. 3 prop, the cuts 12*b* slope inwardly and in the FIG. 4 prop the cuts 12*c* are parallel.

Figure 5:
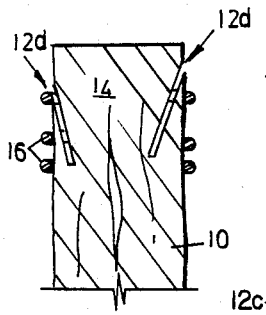
FIGS. 4 and 5 are similar views to that of FIG. 3 of two further embodiments of the prop of the invention.

The cuts 12*d* in the FIG. 5 prop are sloped inwardly from a position on the prop sides a little distance below the end of the prop. Although only two cuts are shown in the props of FIGS. 3 to 5 the props could include four cuts at right angles to each other.

Figure 6:
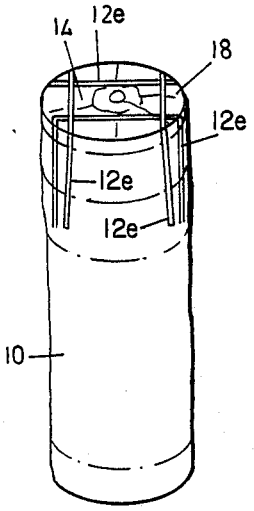
FIG. 6 is a perspective view from above of a further embodiment of the prop.
Figure 7:
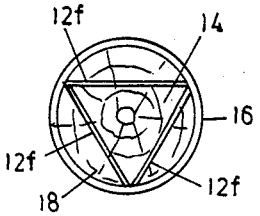
FIGS. 7 and 8 are plan views of yet further embodiments of the prop.

The FIGS. 6 and 7 props include respectively four and three cuts, designated 12*e* and 12*f* respectively which may slope either inwardly towards the prop axis or outwardly away from it. The chain lines in FIG. 6 indicate the positions of the hoops 16.

The pole or prop in each embodiment is substantially cylindrical at least at its end as shown in the drawings. Each of the cut slots in the embodiments of FIGS. 1 through 7 are planar.

Figure 8:
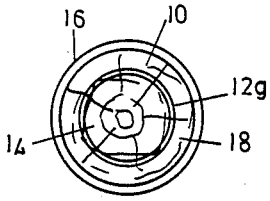

In the prop of FIG. 8 the cut 12*g* is circular and parallel sided.

It is important in all embodiments of the prop that the various cuts 12*a* to 12*g* are, regardless of their angle and position on the prop, equally spaced and symmetrical about the prop axis to ensure even mushrooming of the prop core 14 as the prop yields under load. The timber 18 on the outside of the cuts and core 14 in the prop embodiments, such as in FIGS. 1 and 6, in which the cuts slope from the prop ends towards the pole sides is preferably not separated from the pole timber for ease of handling.

The position and angle of the cuts in the prop as well as their distance from the prop axis vary the yield characteristics of the prop quite considerably and these parameters of the prop need to be carefully predetermined for particular prop performance characteristics. The positioning of the hoops 16 on the cut end of the prop is important as is the material from which they are made. Although the hoops 16 are not shown on all of the illustrated props they are essential.

In use of the prop of the invention, under increasing compressive load between a closing hanging and footwall in a deep level mine, the prop core 14 which is of reduced cross-section begins to burr or mushroom radially outwardly from the end of the prop, as is the case with any other timber prop having an end or ends of cross-section less than that of the body of the prop. With the prop of the invention, however, the timber sections 18 which are radially outward of the core 14 and which are circumscribed by the hoops 16, initially, yieldably restrain transverse expansion of the core timber. It is to be noted that the section 18 are far more compressible across the grain, i.e. radially outwardly, than in the grain direction 16. The yieldable restraint so imposed on the core tends to prevent the burring core from brushing to one side or the other to skew the prop as it is further shortened in length under load. When the timber which has been cut from the core is almost fully compressed against the hoops 16 the hoops begin, because of the ductility of the mild steel, sequentially to yield radially from the upper to the lower hoop and impose yet further continuing restraint on the radially expanding mass of burred timber between the cut timber and the hoops.

As the prop is shortened under load the lower ends of the cut timber sections, particularly in those embodiments in which the direction of the cuts is from the end away from the prop axis such as in FIGS. 1 and 6, tend to break away from the prop body because of the vertical load imposed on them and move down over the sides of the prop as the lower hoop 16 expands radially to enable them to do so and further hold the crushing core timber against uncontrolled brushing to one side of the prop axis.

Although the props which have only two cuts or cut slots, such as in the FIGS. 1 and 2 prop, perform much as described above, the props, such as those in FIGS. 6 to 8, which have their central cores surrounded by timber which is cut from the core, are superior performers because of the total enclosure of and restraint on the core in use.

The invention is not limited to the precise details as herein described and the rod shaped hoops could, for example, be replaced by flat mild steel bands or other suitable yieldable material. Additionally, both ends of the prop could carry cuts 12 and hoops 16.

I claim:

1. A mine prop comprising a timber pole having a pole axis and formed with four planar cut slots adjacent one end of said pole and over a portion of its length to form a core having a rectangular cross-section which is of reduced cross-section with respect to said pole, and which is one piece with remaining uncut portions of the timber pole each on an outside of each cut slot respectively, and at least one hoop surrounding the pole over the core and over the uncut portions of the pole to restrain expansion of the core and the uncut portions of the pole in a direction transverse to the pole axis when the prop is under a compressive load in its axial direction, said cut slots including two pairs of parallel cut slots with a cut slot in one pair being at right angles to a cut slot in another pair, each slot sloping from the pole end, away from the pole axis so that each uncut portion forms a wedge having decreasing cross-section in a direction away from said pole one end, the core having an increasing cross-section in a direction away from the pole one end.

2. A prop according to claim 1, wherein said one end of said pole is cylindrical and untapered.

3. A prop according to claim 2, including a second hoop axially spaced from the first mentioned hoop and surrounding the core and uncut portions of the pole, and a third hoop axially spaced from said second hoop and from the end of the pole, at a location of the pole axially spaced from the cut slots.

4. A prop as claimed in claim 2 in which the hoop is made from a yieldable material.

5. A prop as claimed in claim 4 in which the material is mild steel.

6. A prop as claimed in claim 4 in which the prop includes a plurality of hoops which are spaced from one another in the axial direction of the prop over the length of the core.

7. A prop as claimed in claim 6 in which the hoops are circular in cross-section.

* * * * *